US008044912B2

(12) United States Patent
Zhan et al.

(10) Patent No.: US 8,044,912 B2
(45) Date of Patent: Oct. 25, 2011

(54) SEMICONDUCTOR DEVICE INCLUDING CORRECTION PARAMETER GENERATOR AND METHOD OF GENERATING CORRECTION PARAMETERS

(75) Inventors: JinFeng Zhan, Yongin-si (KR); JongSeon Kim, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1026 days.

(21) Appl. No.: 11/829,554

(22) Filed: Jul. 27, 2007

(65) Prior Publication Data

US 2008/0170051 A1 Jul. 17, 2008

(30) Foreign Application Priority Data

Jan. 11, 2007 (KR) ..... 10-2007-0003262

(51) Int. Cl.
*G09G 5/00* (2006.01)

(52) U.S. Cl. ..... 345/98

(58) Field of Classification Search ..... 345/98
See application file for complete search history.

(56) References Cited

U.S. PATENT DOCUMENTS 5,696,941 A * 12/1997 Jung ..... 710/3
2006/0152463 A1 * 7/2006 Furihata et al. ..... 345/98

FOREIGN PATENT DOCUMENTS

| | | |
|---|---|---|
| JP | 07-262081 | 10/1995 |
| JP | 2004-304390 | 10/2004 |
| JP | 2006-195170 | 7/2006 |
| KR | 100135846 | 1/1998 |

* cited by examiner

*Primary Examiner* — Richard Hjerpe
*Assistant Examiner* — Jeffrey Steinberg
(74) *Attorney, Agent, or Firm* — F. Chau & Associates, LLC

(57) ABSTRACT

A semiconductor device includes an address generator and an output unit. The address generator is configured to output a plurality of addresses in response to a first number of most significant bits of a current pixel value including a first selection bit and a second number of most significant bits of a previous pixel value including a second selection bit. The output unit is configured to determine correction parameters which respectively correspond to the plurality of addresses, in response to the plurality of addresses, to select an index pattern from a plurality of index patterns in response to the first selection bit and the second selection bit, and to arrange the determined correction parameters into the selected index pattern to output arranged correction parameters. The index pattern is a pattern that can be generated according to positions of the determined correction parameters in a look-up table including the plurality of indexes.

18 Claims, 16 Drawing Sheets

FIG. 5

| Index | | | 0 | 1 | 2 | 3 | 4 | 5 | 6 | 7 | 8 | 9 | A | B | C | D | E | F | 10 |
|---|---|---|---|---|---|---|---|---|---|---|---|---|---|---|---|---|---|---|---|
| | | | Previous Pixel | | | | | | | | | | | | | | | | |
| | | | 0 | 16 | 32 | 48 | 64 | 80 | 96 | 112 | 128 | 144 | 160 | 176 | 192 | 208 | 224 | 240 | 256 |
| 0 | Current Pixel | 0 | 0 | | | | | | | | | | | | | | | | |
| 1 | | 16 | | 16 | | | | | | | | | | | | | | | |
| 2 | | 32 | | | 32 | | | | | | | | | | | | | | |
| 3 | | 48 | | | | 48 | | | | | | | | | | | | | |
| 4 | | 64 | | | | | 64 | | | | | | | | | | | | |
| 5 | | 80 | | | | | | 80 | | | | | | | | | | | |
| 6 | | 96 | | | | | | | 96 | | | | | | | | | | |
| 7 | | 112 | | | | | | | | 112 | | | | | | | | | |
| 8 | | 128 | | | | | | | | | 128 | | | | | | | | |
| 9 | | 144 | | | | | | | | | | 144 | | | | | | | |
| A | | 160 | | | | | | 213 | 189 | | | | 160 | | | | | | |
| B | | 176 | | | | | | 232 | 212 | | | | | 176 | | | | | |
| C | | 192 | | | | | | | | | | | | | 192 | | | | |
| D | | 208 | | | | | | | | | | | | | | 208 | | | |
| E | | 224 | | | | | | | | | | | | | | | 224 | | |
| F | | 240 | | | | | | | | | | | | | | | | 240 | |
| 10 | | 256 | | | | | | | | | | | | | | | | | 256 |

FIG. 6

| | | | | | | | | | | | | | | | | |
|---|---|---|---|---|---|---|---|---|---|---|---|---|---|---|---|---|
| 0 | 1 | 0 | 1 | 0 | 1 | 0 | 1 | 0 | 1 | 0 | 1 | 0 | 1 | 0 | 1 | 0 |
| 2 | 3 | 2 | 3 | 2 | 3 | 2 | 3 | 2 | 3 | 2 | 3 | 2 | 3 | 2 | 3 | 2 |
| 0 | 1 | 0 | 1 | 0 | 1 | 0 | 1 | 0 | 1 | 0 | 1 | 0 | 1 | 0 | 1 | 0 |
| 2 | 3 | 2 | 3 | 2 | 3 | 2 | 3 | 2 | 3 | 2 | 3 | 2 | 3 | 2 | 3 | 2 |
| 0 | 1 | 0 | 1 | 0 | 1 | 0 | 1 | 0 | 1 | 0 | 1 | 0 | 1 | 0 | 1 | 0 |
| 2 | 3 | 2 | 3 | 2 | 3 | 2 | 3 | 2 | 3 | 2 | 3 | 2 | 3 | 2 | 3 | 2 |
| 0 | 1 | 0 | 1 | 0 | 1 | 0 | 1 | 0 | 1 | 0 | 1 | 0 | 1 | 0 | 1 | 0 |
| 2 | 3 | 2 | 3 | 2 | 3 | 2 | 3 | 2 | 3 | 2 | 3 | 2 | 3 | 2 | 3 | 2 |
| 0 | 1 | 0 | 1 | 0 | 1 | 0 | 1 | 0 | 1 | 0 | 1 | 0 | 1 | 0 | 1 | 0 |
| 2 | 3 | 2 | 3 | 2 | 3 | 2 | 3 | 2 | 3 | 2 | 3 | 2 | 3 | 2 | 3 | 2 |
| 0 | 1 | 0 | 1 | 0 | 1 | 0 | 1 | 0 | 1 | 0 | 1 | 0 | 1 | 0 | 1 | 0 |
| 2 | 3 | 2 | 3 | 2 | 3 | 2 | 3 | 2 | 3 | 2 | 3 | 2 | 3 | 2 | 3 | 2 |
| 0 | 1 | 0 | 1 | 0 | 1 | 0 | 1 | 0 | 1 | 0 | 1 | 0 | 1 | 0 | 1 | 0 |
| 2 | 3 | 2 | 3 | 2 | 3 | 2 | 3 | 2 | 3 | 2 | 3 | 2 | 3 | 2 | 3 | 2 |
| 0 | 1 | 0 | 1 | 0 | 1 | 0 | 1 | 0 | 1 | 0 | 1 | 0 | 1 | 0 | 1 | 0 |
| 2 | 3 | 2 | 3 | 2 | 3 | 2 | 3 | 2 | 3 | 2 | 3 | 2 | 3 | 2 | 3 | 2 |
| 0 | 1 | 0 | 1 | 0 | 1 | 0 | 1 | 0 | 1 | 0 | 1 | 0 | 1 | 0 | 1 | 0 |

FIG. 8A

LUT of Index 0

| | 0 | 1 | 2 | 3 | 4 | 5 | 6 | 7 | |
|---|---|---|---|---|---|---|---|---|---|
| 0 | (0,0) | (0,2) | (0,4) | (0,6) | (0,8) | (0,10) | (0,12) | (0,14) | |
| 1 | (2,0) | (2,2) | (2,4) | (2,6) | (2,8) | (2,10) | (2,12) | (2,14) | |
| 2 | (4,0) | (4,2) | (4,4) | (4,6) | (4,8) | (4,10) | (4,12) | (4,14) | |
| 3 | (6,0) | (6,2) | (6,4) | (6,6) | (6,8) | (6,10) | (6,12) | (6,14) | AP1 |
| 4 | (8,0) | (8,2) | (8,4) | (8,6) | (8,8) | (8,10) | (8,12) | (8,14) | |
| 5 | (10,0) | (10,2) | (10,4) | (10,6) | (10,8) | (10,10) | (10,12) | (10,14) | |
| 6 | (12,0) | (12,2) | (12,4) | (12,6) | (12,8) | (12,10) | (12,12) | (12,14) | |
| 7 | (14,0) | (14,2) | (14,4) | (14,6) | (14,8) | (14,10) | (14,12) | (14,14) | |
| 8 | (16,0) | (16,2) | (16,4) | (16,6) | (16,8) | (16,10) | (16,12) | (16,14) | AP2 |
| 9 | (0,16) | (2,16) | (4,16) | (6,16) | (8,16) | (10,16) | (12,16) | (14,16) | |
| 10 | (16,16) | | | | | | | | AP3 |

FIG. 8B

LUT of Index 1

| | 0 | 1 | 2 | 3 | 4 | 5 | 6 | 7 |
|---|---|---|---|---|---|---|---|---|
| 0 | (0,1) | (0,3) | (0,5) | (0,7) | (0,9) | (0,11) | (0,13) | (0,15) |
| 1 | (2,1) | (2,3) | (2,5) | (2,7) | (2,9) | (2,11) | (2,13) | (2,15) |
| 2 | (4,1) | (4,3) | (4,5) | (4,7) | (4,9) | (4,11) | (4,13) | (4,15) |
| 3 | (6,1) | (6,3) | (6,5) | (6,7) | (6,9) | (6,11) | (6,13) | (6,15) |
| 4 | (8,1) | (8,3) | (8,5) | (8,7) | (8,9) | (8,11) | (8,13) | (8,15) |
| 5 | (10,1) | (10,3) | (10,5) | (10,7) | (10,9) | (10,11) | (10,13) | (10,15) |
| 6 | (12,1) | (12,3) | (12,5) | (12,7) | (12,9) | (12,11) | (12,13) | (12,15) |
| 7 | (14,1) | (14,3) | (14,5) | (14,7) | (14,9) | (14,11) | (14,13) | (14,15) |
| 8 | (16,1) | (16,3) | (16,5) | (16,7) | (16,9) | (16,11) | (16,13) | (16,15) |

FIG. 8C

LUT of Index 2

| | 0 | 1 | 2 | 3 | 4 | 5 | 6 | 7 |
|---|---|---|---|---|---|---|---|---|
| 0 | (1,0) | (1,2) | (1,4) | (1,6) | (1,8) | (1,10) | (1,12) | (1,14) |
| 1 | (3,0) | (3,2) | (3,4) | (3,6) | (3,8) | (3,10) | (3,12) | (3,14) |
| 2 | (5,0) | (5,2) | (5,4) | (5,6) | (5,8) | (5,10) | (5,12) | (5,14) |
| 3 | (7,0) | (7,2) | (7,4) | (7,6) | (7,8) | (7,10) | (7,12) | (7,14) |
| 4 | (9,0) | (9,2) | (9,4) | (9,6) | (9,8) | (9,10) | (9,12) | (9,14) |
| 5 | (11,0) | (11,2) | (11,4) | (11,6) | (11,8) | (11,10) | (11,12) | (11,14) |
| 6 | (13,0) | (13,2) | (13,4) | (13,6) | (13,8) | (13,10) | (13,12) | (13,14) |
| 7 | (15,0) | (15,2) | (15,4) | (15,6) | (15,8) | (15,10) | (15,12) | (15,14) |
| 8 | (1,16) | (3,16) | (5,16) | (7,16) | (9,16) | (11,16) | (13,16) | (15,16) |

FIG. 8D

LUT of Index 3

| | 0 | 1 | 2 | 3 | 4 | 5 | 6 | 7 |
|---|---|---|---|---|---|---|---|---|
| 0 | (1,1) | (1,3) | (1,5) | (1,7) | (1,9) | (1,11) | (1,13) | (1,15) |
| 1 | (3,1) | (3,3) | (3,5) | (3,7) | (3,9) | (3,11) | (3,13) | (3,15) |
| 2 | (5,1) | (5,3) | (5,5) | (5,7) | (5,9) | (5,11) | (5,13) | (5,15) |
| 3 | (7,1) | (7,3) | (7,5) | (7,7) | (7,9) | (7,11) | (7,13) | (7,15) |
| 4 | (9,1) | (9,3) | (9,5) | (9,7) | (9,9) | (9,11) | (9,13) | (9,15) |
| 5 | (11,1) | (11,3) | (11,5) | (11,7) | (11,9) | (11,11) | (11,13) | (11,15) |
| 6 | (13,1) | (13,3) | (13,5) | (13,7) | (13,9) | (13,11) | (13,13) | (13,15) |
| 7 | (15,1) | (15,3) | (15,5) | (15,7) | (15,9) | (15,11) | (15,13) | (17,15) |

FIG. 9A

Address of LUT 0

| {cur[4], pre[4]} | &cur[7:4] | &pre[7:4] | Address of LUT 0 |
|---|---|---|---|
| 00 | 0 | 0 | A0 |
| 01 | 0 | 0 | A1 |
| 10 | 0 | 0 | A2 |
| 11 | 0 | 0 | A3 |
| xx | 1 | 0 | A4 |
| xx | 0 | 1 | A5 |
| xx | 1 | 1 | 80 |

FIG. 9B

Address of LUT 1

| {cur[4], pre[4]} | &cur[7:4] | &pre[7:4] | Address of LUT 1 |
|---|---|---|---|
| 00 | 0 | 0 | A1 |
| 01 | 0 | 0 | A0 |
| 10 | 0 | 0 | A3 |
| 11 | 0 | 0 | A2 |
| 01 | 1 | x | A4 |

FIG. 9C

Address of LUT 2

| {cur[4], pre[4]} | &cur[7:4] | &pre[7:4] | Address of LUT 2 |
|---|---|---|---|
| 00 | 0 | 0 | A2 |
| 01 | 0 | 0 | A3 |
| 10 | 0 | 0 | A0 |
| 11 | 0 | 0 | A1 |
| 01 | x | 1 | A5 |

FIG. 9D

Address of LUT 3

| {cur[4], pre[4]} | &cur[7:4] | &pre[7:4] | Address of LUT 3 |
|---|---|---|---|
| 00 | x | x | A3 |
| 01 | x | x | A2 |
| 10 | x | x | A1 |
| 11 | x | x | A0 |

SEMICONDUCTOR DEVICE INCLUDING CORRECTION PARAMETER GENERATOR AND METHOD OF GENERATING CORRECTION PARAMETERS

CROSS-REFERENCE TO RELATED PATENT APPLICATION

This application claims priority to Korean Patent Application No. 2007-0003262, filed on Jan. 11, 2007, in the Korean Intellectual Property Office, the disclosure of which is incorporated by reference in its entirety herein.

BACKGROUND OF THE INVENTION

1. Technical Field

The present disclosure relates to a semiconductor device, and more particularly, to a semiconductor device including a correction parameter generator and a method of generating correction parameters.

2. Discussion of the Related Art

A liquid crystal display (LCD) is an electronic device, which converts diverse electronic information generated by various apparatuses into visual information using liquid crystals. The transparency of the liquid crystals change according to an applied voltage. As compared to a conventional cathode-ray tube (CRT) display, the LCD may have a higher resolution, be thinner, and consume less power. However, when displaying moving pictures, the LCD may suffer from time delays caused by changes in molecular arrangements, which occur when an electric field is applied to a liquid crystal material. The time delays may cause blurring or tailing. Liquid crystal molecules in an LCD may move slowly. Overdrive technology may be used to increase the response speed of the liquid crystal molecules by correcting a video signal of the LCD.

In some current overdrive technologies, correction parameters are selected from a look-up table (LUT). The LUT stores correction parameters based on the combination of a pixel value of a previous frame and a pixel value of a current frame. The selected correction parameters are interpolated and a corrected video signal is output as a result of the interpolation. The LUT stores correction parameters, which are determined based on panel characteristics of an LCD and may be obtained through experimentation. The LUT may be stored in memory.

However, memories that store the LUT require a large capacity, for example, 256*256 bytes. Methods for using smaller capacity memories have been proposed. However, when adjacent parameters are selected from the LUT in these methods in which four parameters are simultaneously selected, the parameters may be inadvertently selected again, causing data redundancy or a waste of clock cycles.

SUMMARY OF THE INVENTION

According to an exemplary embodiment of the present invention, there is provided a semiconductor device including an address generator and an output unit. The address generator is configured to output a plurality of addresses in response to a first number of most significant bits of a current pixel value and a second number of most significant bits of a previous pixel value. The first number of most significant bits includes a first selection bit and the second number of most significant bits includes a second selection bit. The output unit is configured to determine correction parameters, which respectively correspond to the plurality of addresses, in response to the plurality of addresses. The output unit selects one index pattern from a plurality of index patterns in response to the first selection bit and the second selection bit, and arranges the determined correction parameters into the selected index pattern to output arranged correction parameters. The index pattern may be a pattern that can be generated according to positions of the determined correction parameters in a look-up table including the plurality of indexes.

The output unit may include a memory unit and a parameter arranging unit. The memory unit may be configured to output the correction parameters, which respectively corresponds to the plurality of addresses, in response to the plurality of addresses. The parameter arranging unit may be configured to receive the correction parameters from the memory unit and to arrange the received correction parameters into the index pattern in response to the first selection bit and the second selection bit. The memory unit may include a plurality of memories, each of which stores a plurality of correction parameters according to one index among the plurality of indexes.

The address generator may include an address generation section and a plurality of selectors. The address generation section may be configured to generate a plurality of first addresses based on the first number of most significant bits and the second number of most significant bits. The plurality of selectors may each be configured to transmit one address among the plurality of first addresses to a corresponding one among the plurality of memories comprised in the output unit in response to the first number of most significant bits and the second number of most significant bits.

The address generation section may include a first sub-address address generator and a second sub-address generator. The first sub-address generator may be configured to generate a plurality of first sub-addresses in a first matrix pattern in response to the first number of most significant bits and the second number of most significant bits. The second sub-address generator may be configured to generate a plurality of second sub-addresses in a second matrix pattern in response to the first number of most significant bits and the second number of most significant bits. Each of the selectors may transmit one address among the first sub-addresses and the second sub-addresses to the corresponding memory in response to the first number of most significant bits and the second number of most significant bits.

The first sub-address generator may perform adding and shifting on corresponding bits between the first number of most significant bits and the second number of most significant bits to generate the first sub-addresses for selecting a parameter which is selected by the first number of most significant bits and the second number of most significant bits, and parameters, which are in a relationship of the index pattern with respect to the selected parameter, in the look-up table including the plurality of indexes.

The first sub-address generator may include an adding and shifting part configured to perform adding and shifting on the corresponding bits between the first number of most significant bits and the second number of most significant bits to output added and shifted addresses, and an adding part configured to add addresses selected from among the added and shifted addresses to generate the first sub-addresses.

The semiconductor device may further include a ratio generator and a bilinear interpolator. The ratio generator may be configured to calculate a distance ratio between the correction parameters in response to a first number of least significant bits of the current pixel value and a second number of least significant bits of the previous pixel value. The bilinear interpolator may be configured to perform bilinear interpolation based on the correction parameters and the distance ratio output from the ratio generator to generate a correction value for the current pixel value.

Each of the current pixel value and the previous pixel value may indicate a pixel value for a color including red, green, or blue components.

According to an exemplary embodiment of the present invention, there is provided a display apparatus including a controller a display panel, and the above-described semiconductor device. The controller may control input and output of the current pixel value, the previous pixel value, and the correction parameters between the semiconductor device and the display panel.

According to an exemplary embodiment of the present invention, a method of generating correction parameters includes outputting a plurality of addresses in response to a first number of most significant bits of a current pixel value including a first selection bit and a second number of most significant bits of a previous pixel value including a second selection bit, determining correction parameters, which respectively correspond to the plurality of addresses, in response to the plurality of addresses, selecting one index pattern from a plurality of index patterns in response to the first selection bit and the second selection bit, arranging the determined correction parameters into the selected index pattern to generate arranged correction parameters, and outputting the arranged correction parameters. The index pattern may be a pattern that can be generated according to positions of the determined correction parameters in a look-up table including the plurality of indexes.

The outputting the arranged correction parameters may include outputting the correction parameters, which respectively correspond to the plurality of addresses, in response to the plurality of addresses using a memory unit including a plurality of memories, each of which stores a plurality of correction parameters according to one index among the plurality of indexes, and arranging the correction parameters output from the memory unit into the index pattern in response to the first selection bit and the second selection bit.

The outputting of the plurality of addresses may include generating a plurality of first addresses based on the first number of most significant bits and the second number of most significant bits, and transmitting one address among the plurality of first addresses to a corresponding each of the plurality of memories in response to the first number of most significant bits and the second number of most significant bits.

The generating of the plurality of first addresses may include generating a plurality of first sub-addresses in a first matrix pattern in response to the first number of most significant bits and the second number of most significant bits, and generating a plurality of second sub-addresses in a second matrix pattern in response to the first number of most significant bits and the second number of most significant bits. The transmitting of one address among the plurality of first addresses may include transmitting one address among the first sub-addresses and the second sub-addresses to each corresponding memory in response to the first number of most significant bits and the second number of most significant bits.

The generating of the plurality of first sub-addresses may include performing adding and shifting on corresponding bits between the first number of most significant bits and the second number of most significant bits to generate the first sub-addresses for selecting a parameter, which is selected by the first number of most significant bits and the second number of most significant bits, and parameters, which are in a relationship of the index pattern with respect to the selected parameter, in the look-up table including the plurality of indexes.

The generating of the plurality of first sub-addresses may include performing adding and shifting on corresponding bits between the first number of most significant bits and the second number of most significant bits to output added and shifted addresses, and adding addresses selected from among the added and shifted addresses to generate the first sub-addresses.

Each of the current pixel value and the previous pixel value may be indicate a pixel value for a color including red, green, or blue components.

BRIEF DESCRIPTION OF THE DRAWINGS

The above and other features of the present invention will become more apparent by describing in detail exemplary embodiments thereof with reference to the attached drawings in which:

FIG. 5 illustrates a look-up table (LUT) for a memory unit illustrated in FIG. 2, according to an exemplary embodiment of the present invention;

FIG. 6 illustrates an LUT obtained by setting addresses in the LUT illustrated in FIG. 5 to indexes, according to an exemplary embodiment of the present invention;

FIGS. 8A through 8D illustrate exemplary LUTs stored in the memory unit illustrated in FIG. 2:

FIGS. 9A through 9D illustrate exemplary tables showing addresses which are output according to bits of a current pixel and bits of a previous pixel.

DETAILED DESCRIPTION OF EXEMPLARY EMBODIMENTS

Figure 1:
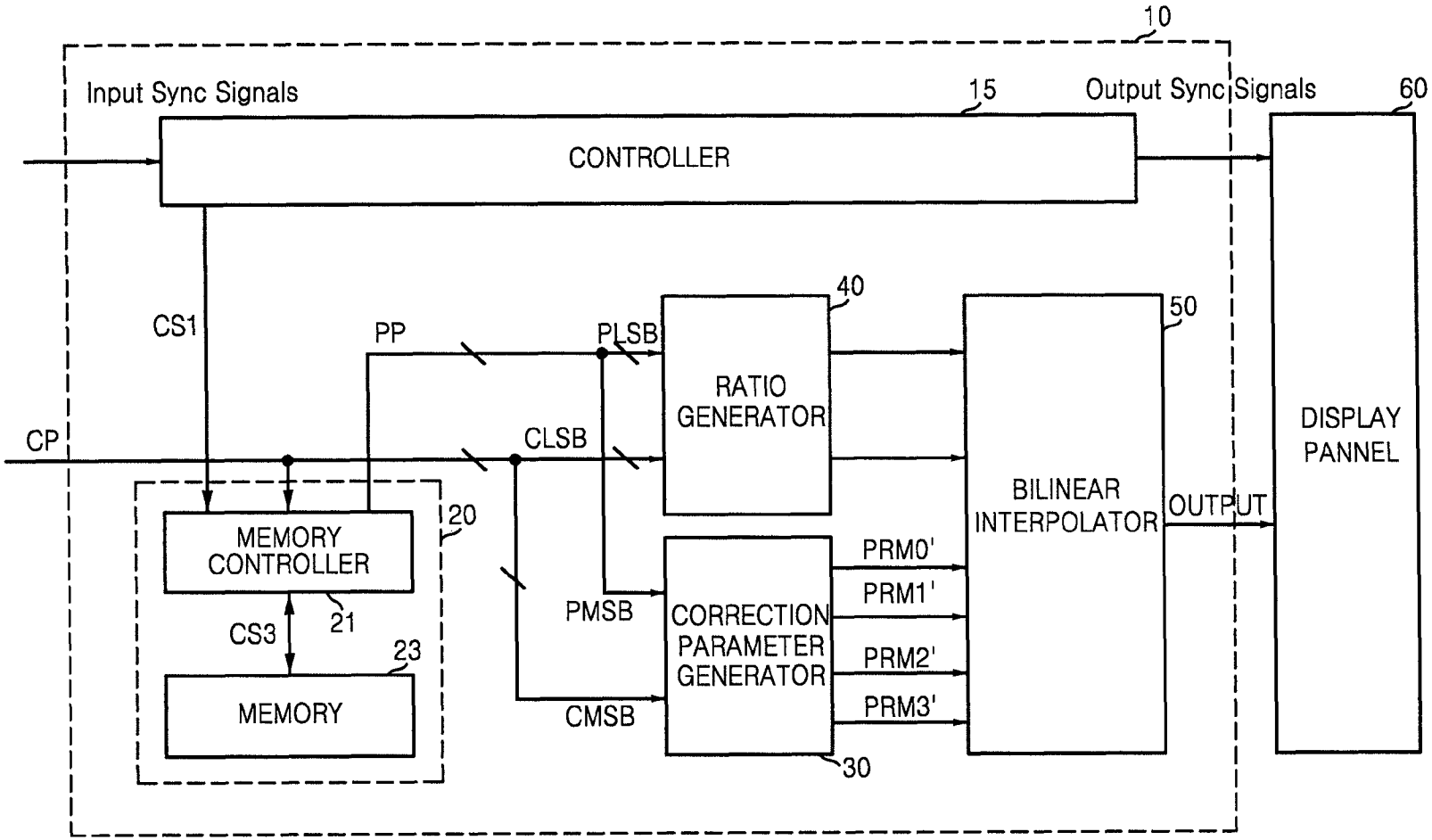
FIG. 1 is a functional block diagram of a semiconductor device including a correction parameter generator according to an exemplary embodiment of the present invention.

The present invention now will be described more fully hereinafter with reference to the accompanying drawings, in which embodiments of the invention are shown. This invention may, however, be embodied in many different forms and should not be construed as limited to the embodiments set forth herein. In the drawings, like numbers may refer to like elements throughout the specification.

It will be understood that when an element is referred to as being "connected" or "coupled" to another element, it can be directly connected or coupled to the other element or intervening elements may be present. FIG. 1 is a functional block diagram of a semiconductor device 10 including a correction parameter generator according to an exemplary embodiment of the present invention. Referring to FIG. 1, the semiconductor device 10 includes a controller a pixel value storage unit 20, a correction parameter generator 30, a ratio generator 40, and a bilinear interpolator 50. The semiconductor device 10 may further include a display panel 60. A flat display apparatus like a liquid crystal display (LCD) apparatus may include the semiconductor device 10 and the display panel 60.

The controller 15 controls the input and output of a current pixel value CP, a previous pixel value PP, and correction parameters PRM0', PRM1', PRM2', and PRM3', generated by the correction parameter generator 30, among the pixel value storage unit 20, the correction parameter generator 30, the ratio generator 40, the bilinear interpolator 50, and the display panel 60.

The pixel value storage unit 20 stores the current pixel value CP and the previous pixel value PP and transmits the previous pixel value PP to the correction parameter generator 30 and the ratio generator 40 in response to a control signal CS1. The current pixel value CP and the previous pixel value PP may indicate a pixel value for a color including red (R), green (G), and blue (B) components. A point in time when the current pixel value CP is input is referred to as a reference point. The previous pixel value PP is a pixel value that is input immediately before the reference point. Accordingly, the current pixel value CP may be output as the previous pixel value PP, for example, when a next frame is input.

The pixel value storage unit 20 includes a memory controller 21 and a memory 23. The memory controller 21 generates a selection signal CS3 for selecting the previous pixel value PP, which is stored in the memory 23, in response to the control signal CS1. The memory controller 21 may receive the current pixel value CP and output it to the memory 23. The memory 23 stores the current pixel value CP and the previous pixel value PP and transmits the previous pixel value PP to the correction parameter generator 30 and the ratio generator 40 via the memory controller 21 in response to the selection signal CS3 output from the memory controller 21. The memory 23 may be embodied by a non-volatile memory such as for example, random access memory (RAM) or static RAM (SRAM).

The correction parameter generator 30 outputs the correction parameters PRM0' through PRM3' in response to a first "n" (where "n" is a natural number, e.g., 4) most significant bits CMSB of the current pixel value CP including a first selection bit and a second "n" most significant bits PMSB of the previous pixel value PP including a second selection bit.

The ratio generator 40 calculates a distance ratio between the correction parameters PRM0' through PRM3' output from the correction parameter generator 30 in response to a first "m" (where "m" is a natural number, e.g. 4) least significant bits CLSB of the current pixel value CP and a second "m" least significant bits PLSB of the previous pixel value PP. For example, when a difference between the correction parameters PRM0' through PRM3' is 16, the first "m" (e.g., m=4) least significant bits CLSB of the current pixel value CP and the second "m" least significant bits PLSB of the previous pixel value PP changes only in a range from "0001" to "1111". Therefore, the distance ratio between the correction parameters PRM0' through PRM3' can be calculated based on the first "m" least significant bits CLSB of the current pixel value GP and the second "m" least significant bits PLSB of the previous pixel value PP.

The bilinear interpolator 50 receives the correction parameters PRM0' through PRM3' output from the correction parameter generator 30 and the distance ratio output from the ratio generator 40, and performs bilinear interpolation based on the received signals to generate a correction value OUTPUT for the current pixel value CP.

The display panel 60 receives the correction value OUTPUT for the current pixel value CP from the bilinear interpolator 50, performs correction of the current pixel value CP, and displays an image based on a corrected pixel value.

Figure 2:
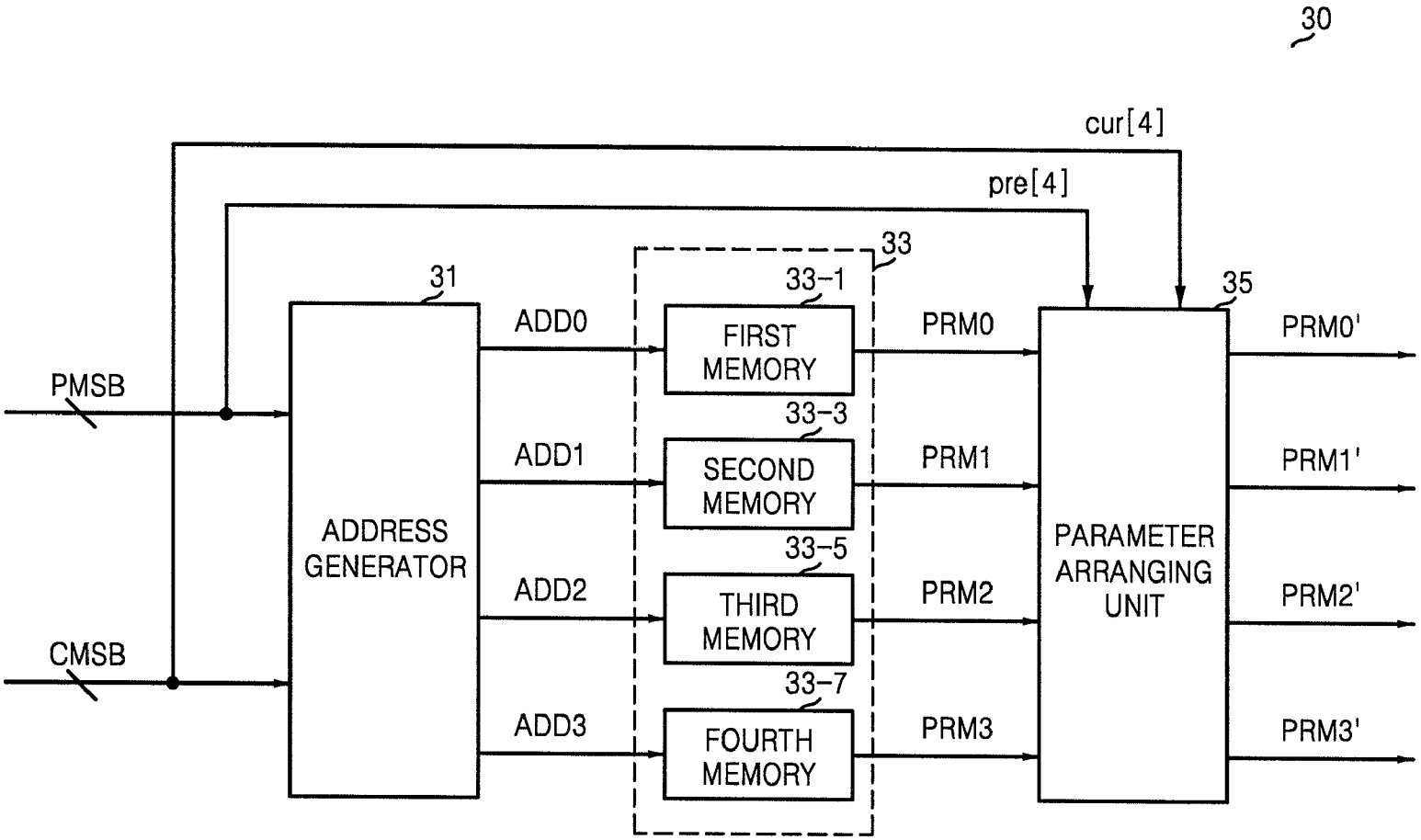
FIG. 2 is a functional block diagram of the correction parameter generator illustrated in FIG. 1 according to an exemplary embodiment of the present invention.
Figure 3:
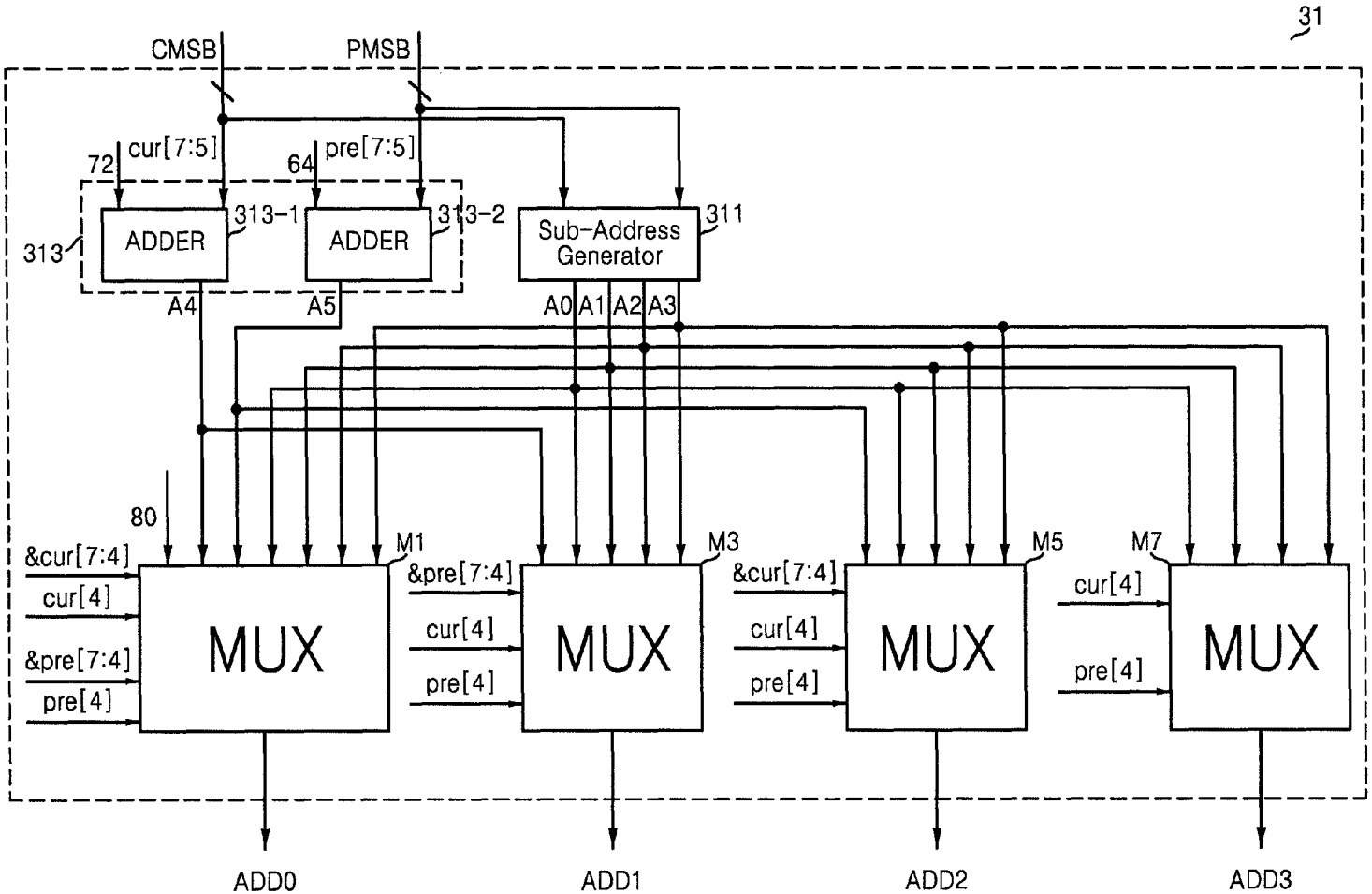
FIG. 3 is a functional block diagram of an address generator illustrated in FIG. 2, according to an exemplary embodiment of the present invention.
Figure 4:
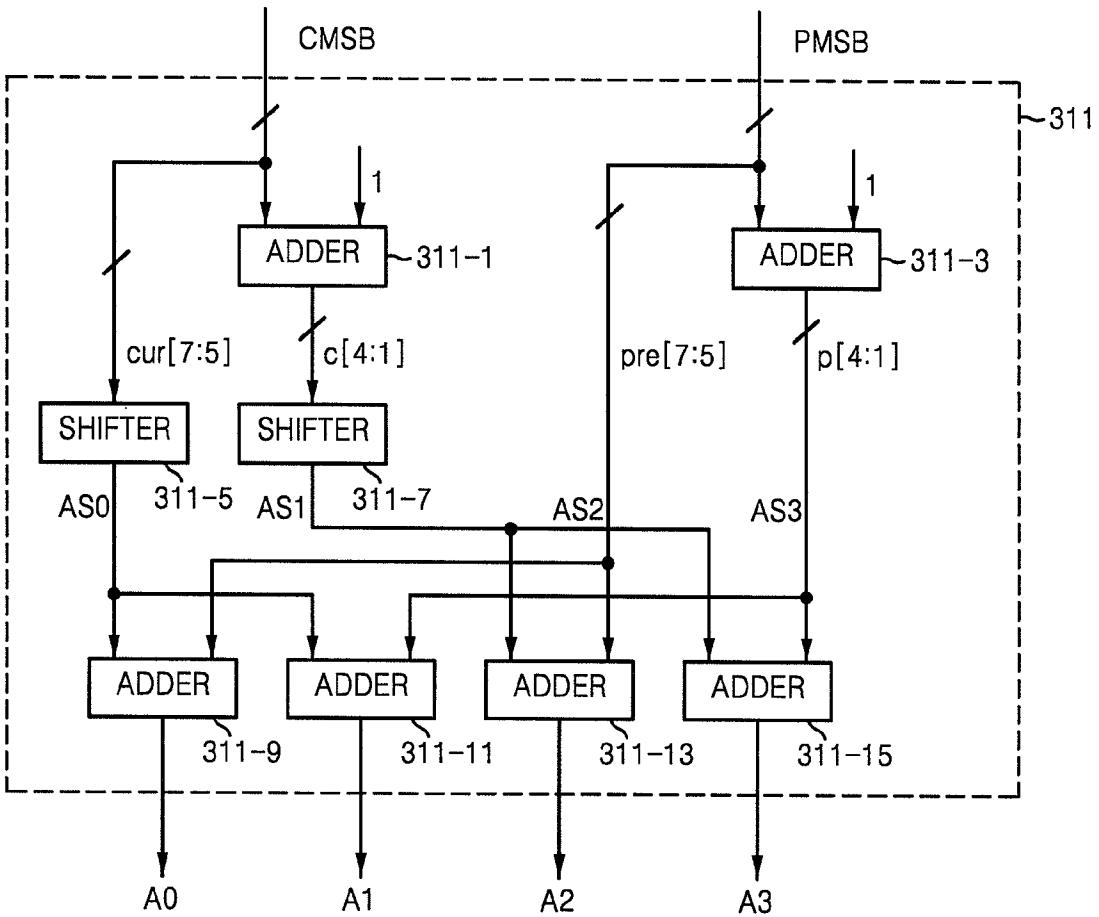
FIG. 4 is a circuit diagram of a first sub-address generator illustrated in FIG. 3, according to an exemplary embodiment of the present invention.

FIG. 2 is a functional block diagram of the correction parameter generator 30 illustrated in FIG. 1 according to an exemplary embodiment of the present invention. FIG. 3 is a functional block diagram of an address generator illustrated in FIG. 2, according to an exemplary embodiment of the present invention. FIG. 4 is a circuit diagram of a first sub-address generator illustrated in FIG. 3, according to an exemplary embodiment of the present invention. Referring to FIGS. 1 through 4, the correction parameter generator 30 includes an address generator 31 and an output unit.

The address generator 31 outputs a plurality of addresses ADD0, ADD1 ADD2, and ADDS in response to the first "n" most significant bits CMSB of the current pixel value CP including a first selection bit cur[4] and the second "n" most significant bits PMSB of the previous pixel value PP including a second selection bit pre[4]. The address generator 31 includes an address generation section and a plurality of selectors M1, M3, M5, and M7. The address generation section includes a first sub-address generator 311 and a second sub-address generator 313 and generates first sub-addresses A0, A1, A2, and A3 and second sub-addresses A4 and A5 based on the first "n" most significant bits CMSB of the current pixel value CP and the second "n" most significant bits PMSB of the previous pixel value PP.

The first sub-address generator 311 generates the first sub-addresses A0 through A3 in a first matrix pattern in response to the first "n" most significant bits CMSB of the current pixel value GP and the second "n" most significant bits PMSB of the previous pixel value PP. The first matrix pattern is a predetermined address format (e.g., an 8*8 byte address, i.e., an address within an area AP1 in FIG. 8A) included in look-up tables (LUTs) (e.g., LUTs illustrated in FIGS. 8A through 8D), which are respectively stored in first through fourth memories 33-1, 33-3, 33-5, and 33-7. Accordingly, the first sub-addresses A0 through A3 are addresses that belong to the first matrix pattern.

The first sub-address generator 311 may perform adding and shifting on corresponding bits between the first "n" most significant bits CMSB of the current pixel value GP and the second "n" most significant bits PMSB of the previous pixel value PP to generate the first sub-addresses A0 through A3. Consequently, the first sub-address generator 311 generates the first sub-addresses A0 through A3 for selecting parameters (e.g., 213, 189, 232, and 212 illustrated in FIG. 5) which are in the relationship of an index pattern (e.g., a pattern illustrated in FIG. 7) with respect to a parameter (e.g., 213 illustrated in FIG. 5), which is selected in an LUT (e.g., an LUT illustrated in FIG. 6) including a plurality of indexes (e.g., 0, 1, 2, and 3) by the first "n" most significant bits CMSB of the current pixel value GP and the second "n" most significant bits PMSB of the previous pixel value PP.

The first sub-address generator 311 may include an adding-and-shifting part and an adding part. The adding-and-shifting part includes a first adder 311-1, a second adder 311-3, a first shifter 3115, and a second shifter 311-7 and performs adding and shifting on corresponding bits between the first "n" most significant bits CMSB of the current pixel value CP and the second "n" most significant bits PMSB of the previous pixel value PP to output added and shifted addresses AS0, AS1, AS2, and AS3.

The first adder 311-1 add "1" to the first "n" most significant bits CMSB of the current pixel value CP while the second adder 311-3 adds "1" to the second "n"; most significant bits PMSB of the previous pixel value PP. The first shifter 311-5 shifts an upper "r" (where "r" is a natural number, e.g., 3) bits Cur[7:5] in the first "n" most significant bits CMSB of the current pixel value CP to the left by "s" (where "s" is a natural number, e.g., 3). The first shifter 311-5 may include a selector (not shown) to select the upper "r" bits Cur[7:5] from the first "n" most significant bits CMSB of the current pixel value CP. The second shifter 311-7 selects "p" (where "p" is a natural number, e.g., 4) bits C[4:1] from the first "n" most significant bits CMSB of the current pixel value CP, to which "1" has been added by the first adder 311-1, and shifts the selected "p" bits C[4:1] to the left by "s". The second shifter 311-7 may include a selector (not shown) to select the "p" bits C[4:1] from the first "n" most significant bits CMSB of the bit-added current pixel value CP.

Accordingly, when LUTs (e.g., LUTs illustrated in FIGS. 8A through 8D), which are respectively stored in the first through fourth memories 33-1 through 33-7, have a predetermined address format (e.g., an 8*8 byte address) and when the added address is shifted to the left by "s" to determine an address of is parameters which are in the relationship of an index pattern (e.g., a pattern illustrated in FIG. 7), the added address is converted into an address expressed by a multiple of $2^3$ (=8) and can thus represent an address of each of the first through fourth memories 33-1 through 33-7 having the predetermined address format.

The adding part includes a third adder 311-9, a fourth adder 311-11, a fifth adder 311-13, and a sixth adder 311-15, each of which adds addresses selected from among the added and shifted addresses AS0, AS1, AS2, and AS3 to generate the first sub-addresses A0 through A3.

The third adder 311-9 adds the first add and shifted address AS0 output from the first shifter 311-5 and the third added and shifted address AS2 to generate the first sub-address A0. The third added and shifted address AS2 may be an upper "r" bits Pre[7:5] selected from the second "n" most significant bits PMSB of the previous pixel value PP.

The fourth adder 311-11 adds the first added and shifted address AS0 output from the first shifter 311-5 and the fourth added and shifted address AS3 output from the second adder 311-3 to generate the first sub-address A1. The fourth added and shifted address AS0 may be "p" bits P[4:1] selected from the second "n" most significant bits PMSB of the previous pixel value PP, to which "1" has been added.

The fifth adder 311-13 adds the second added and shifted address AS1 output from the second shifter 311-7 and the third added and shifted address AS2 to generate the first sub-address A2. The third added and shifted address AS2 may be an upper "r" bits Pre[7:5] selected from the second "n" most significant bits PMSB of the previous pixel value PP.

The sixth adder 311-15 adds the second added and shifted address AS1 output from the second shifter 311-7 and the fourth added and shifted address AS3 output from the second adder 311-3 to generate the first sub-address A3. The fourth added and shifted address AS3 may be "p" bits P[4:1] selected from the second "n" most significant bits PMSB of the previous pixel value PP, to which "1" has been added.

The third and fifth adders 311-9 and 311-13 may include a predetermined selector (not shown) to select the upper "r" bits Pre[7:5] from the second "n" most significant bits PMSB of the previous pixel value PP during addition. Further, the fourth and sixth adders 311-11 and 311-15 may include a predetermined selector (not shown) to select the "p" bits P[4:1] from the second "n" most significant bits PMSB of the previous pixel value PP, to which "1" has been added.

The second sub-address generator 313 generates the second sub-addresses A4 and A5 having a second matrix pattern in response to the first "In" most significant bits CMSB of the current pixel value CP and the second "n" most significant bits PMSB of the previous pixel value PP. The second matrix pattern is a pattern having a parameter address located in an area (e.g., an area AP2 illustrated in FIG. 8A) of a predetermined address format (e.g., an 8*8 byte address) in LUTs (e.g., LUTs illustrated in FIGS. 8A through 8D), which are respectively stored in the first through fourth memories 33-1 through 33-7. The second sub-addresses A4 and A5 are addresses that belong to the second matrix pattern.

The second sub-address generator 313 includes a seventh adder 313-1 and an eighth adder 313-2. The seventh adder 313-1 adds a decimal "72" to the first "n" most significant bits CMSB of the current pixel value CP to generate the second sub-address A4. The seventh adder 313-1 may select an upper "r" bits Cur[7:5] from the first "n" most significant bits CMSB of the current pixel value CP and add the decimal "72" to the selected upper "r" bits Cur[7:5] to generate the second sub-address A4. The seventh adder 313-1 may include a separate selector (not shown).

The eighth adder 313-2 adds a decimal "64" to the second "n" most significant bits PMSB of the previous pixel value PP to generate the second sub-address A5. The eighth adder 313-2 may select an upper "r" bits Pre[7:5] from the second "n" most significant bits PMSB of the previous pixel value PP and add the decimal "64" to the selected upper "r" bits Pre[7:5] to generate the second sub-address A5. The eighth adder 313-2 may include a separate selector (not shown).

The decimal numbers "72" and "64" are calculated to set the addresses of parameters PRM0, PRM1, PRM2, and PRM3, which are positioned in an area (e.g. an area AP2 or AP3 illustrated in FIG. 8A) of a predetermined address format (e.g., an 8*8 byte address) among addresses included in LUTs (e.g., LUTs illustrated in FIGS. 8A through 8D), which are respectively stored in the first through fourth memories 33-1 through 33-7.

Each of the selectors M1, M3, M5, and M7 transmits one address among the first sub-addresses A0 through A3, the second sub-addresses A4 and A5, and a third address 80 to a corresponding one among the first through fourth memories 33-1 through 33-7 in response to corresponding bits among a plurality of bits &cur[7:4] cur[4], pre[4] and &pre[7:4].

The first selector M1 transmits one address among the first sub-addresses A0 through A3 the second sub-addresses A4 and A5, and the third address 80 to the first memory 33-1 in response to third selection bits &cur[7:4], cur[4], pre[4], and &pre[7:4]. The second selector M3 transmits one address among the first sub-addresses A0 through AS3 and the second sub-address A4 to the second memory 33-3 in response to fourth selection bits cur[4], pre[4], and &pre[7:4]. The third selector M5 transmits one address among the first sub-addresses A0 through A3 and the second sub-address A5 to the third memory 335 in response to fifth selection bits &cur[7:4], cur[4], and pre[4]. The fourth selector M7 transmits one address among the first sub-addresses A0 through A3 to the fourth memory 33-7 in response to sixth selection bits cur[4] and pre[4].

The output unit includes the memory unit 33 and a parameter arranging unit 35. The output unit determines correction parameters PRM0. PRM1, PRM2, and PRM3, which respectively correspond to the plurality of the addresses ADD0, ADD1, ADD2, and ADD3, in response to the plurality of the addresses ADD0, ADD1, ADD2, and ADD3, selects one index pattern from a plurality of index patterns (e.g., index patterns illustrated in FIG. 7) in response to a first selection bit cur[4] and a second selection bit pre[4], and arranges the determined correction parameters PRM0 through PRM3 into the selected index pattern to output the arranged correction parameters PRM0' through PRM3'. The index pattern may be a pattern (e.g., one of patterns (a), (b), (c), and (d) illustrated in FIG. 7) that can be generated according to the positions of the determined is; correction parameters PRM0 through PRM3 in an LUT (e.g., the LUT illustrated in FIG. 6) including a plurality of indexes.

According to an exemplary embodiment of the present invention, when the arranged correction parameters PRM0' through PRM3' are selected from a LUT, they are not directly selected from the LUT illustrated in FIG. 5, but the correction parameters PRM0 through PRM3 which are respectively stored in the first through fourth memories 33-1 through 33-7 by indexes, are selected using the LUT illustrated in FIG. 6, which is obtained by setting addresses in the LUT illustrated in FIG. 5 to indexes. The selected correction parameters PRM0 through PRM3 may be arranged so that the correction parameters PRM0 through PRM3 can be simultaneously selected from the respective first through fourth memories 33-1 through 33-7, thereby reducing or preventing wasted clock cycles.

The memory unit 33 outputs the correction parameters PRM0 through PRM3, which respectively correspond to the addresses ADD0, ADD1, ADD2, and ADD3, in response to the addresses ADD0, ADD1, ADD2, and ADD3. The memory unit 33 may include the first through fourth memories 33-1 through 33-7 each of which includes an LUT that stores a plurality of correction parameters PRM0 through PRM3 according to an index among a plurality of indexes (e.g., 0, 1, 2, and 3).

The first memory 33-1 includes a first LUT (FIG. 5A) that stores correction parameters having an index of "0" in the LUT illustrated in FIG. 6. The second memory 33-3 includes a second LUT (FIG. 5B) that stores correction parameters having an index of "1" in the LUT illustrated in FIG. 6. The third memory 335 includes a third LUT (FIG. 5C) that stores correction parameters having an index of "2" in the LUT illustrated in FIG. 6. The fourth memory 33-7 includes a fourth LUT (FIG. 8D) that stores correction parameters having an index of "3" in the LUT illustrated in FIG. 6.

The parameter arranging unit 35 receives the correction parameters PRM0 through PRM3 and arranges the correction parameters PRM0 through PRM3 into an index pattern in response to the first selection bit cur[4] and the second selection bit pre[4] to output the arranged correction parameters PRM0' through PRM3'.

The first selection bit cur[4] may be a q-th bit (where "q" is a natural number, e.g., 4) in the first "n" most significant bits CMSB of the current pixel value CP and the second selection bit pre[4] may be a q-th bit in the second "n" most significant bits PMSB of the previous pixel value PP. For example, when the combination (cur[4],pre[4]) of the first selection bit cur[4] and the second selection bit pre[4] is (00), the index pattern may be the index pattern (a) illustrated in FIG. 7. When the combination is (0.1), the index pattern may be the index pattern (b) illustrated in FIG. 7. When the combination is (1,0), the index pattern may be the index pattern (c) illustrated in FIG. 7. When the combination is (1,1), the index pattern may be the index pattern (d) illustrated in FIG. 7.

Figure 7:
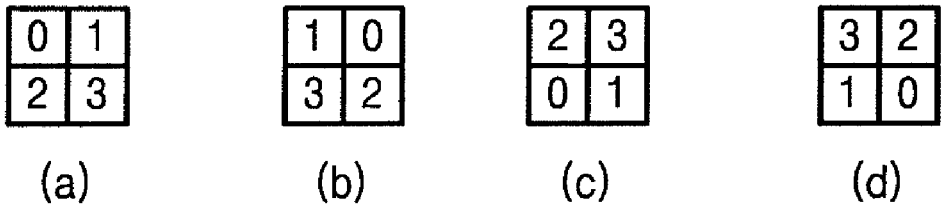
FIG. 7 illustrates index patterns which may appear in the LUT illustrated in FIG. 6.
Figure 10:
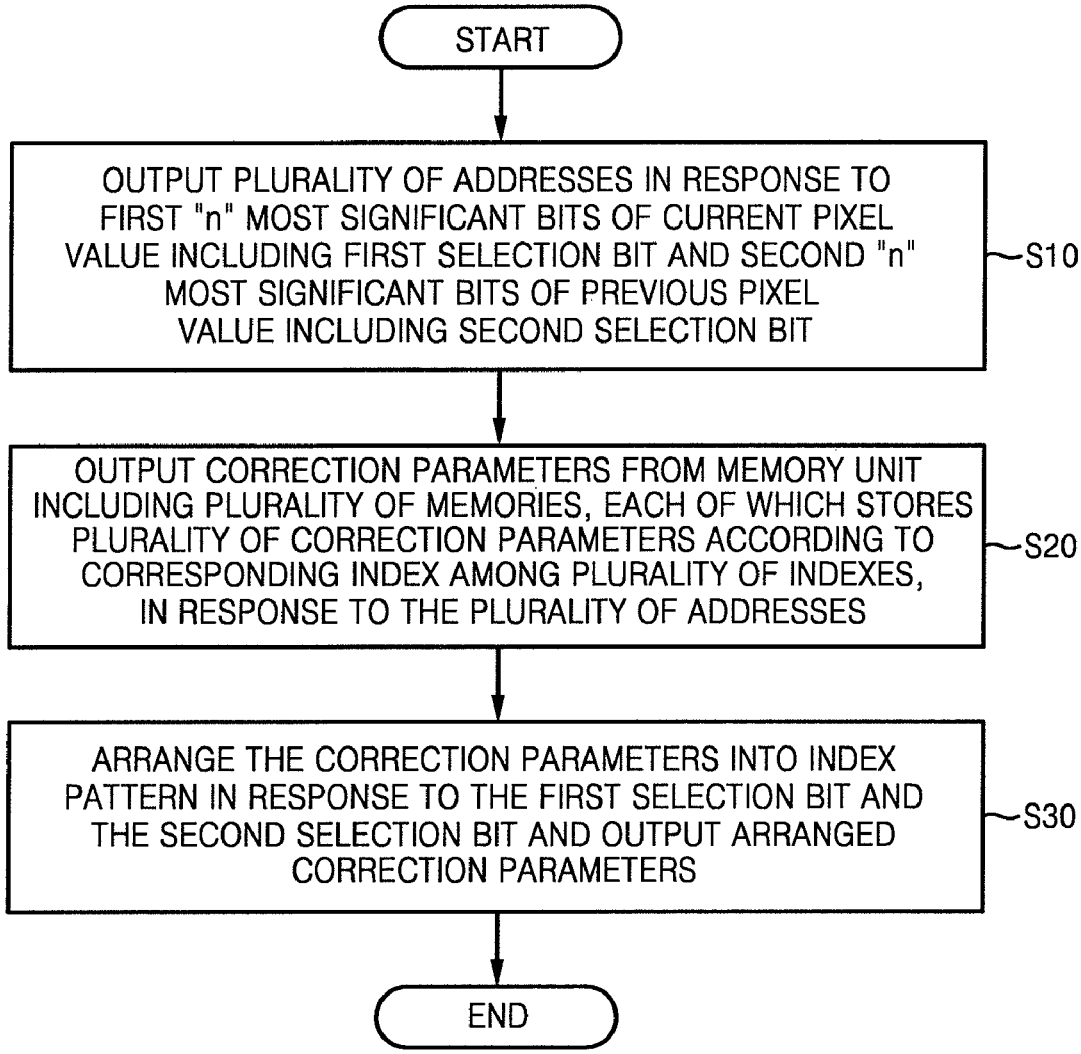
FIG. 10 is a flowchart of a method of generating correction parameters according to an exemplary embodiment of the present invention.

FIG. 5 illustrates the LUT matched with the memory unit 33 illustrated in FIG. 2. FIG. 6 illustrates the LUT obtained by setting addresses in the LUT illustrated in FIG. 5 to indexes. FIG. 7 illustrates index patterns which may appear in the LUT illustrated in FIG. 6. FIGS. 8A through 8D illustrate LUTs stored in the memory unit 33 illustrated in FIG. 2. FIGS. 9A through 9D illustrate tables showing addresses which are output according to bits of a current pixel and bits of a previous pixel. FIG. 10 is a flowchart of a method of generating correction parameters according to an exemplary embodiment of the present invention.

The method of FIG. 10 will be described in detail with reference FIGS. 1-10 and the following example, where it is assumed that the current pixel value CP is a decimal "168" (i.e., a binary "10101000") and the previous pixel value PP is a decimal "90" (i.e., a binary "01011010"). It is further assumed that the first through fourth memories 33-1 through 33-7 have an 8*8, byte address format and each stores addresses and correction parameters according to a corresponding index among indexes of 0, 1, 2, and 3 in the LUT illustrated in FIG. 6. In an operation S10, the address generator 31 outputs a plurality of addresses (e.g., ADD0=42, ADD1=43, ADD2=42, and ADD3=43) in response to the first "n" most significant bits CMSB (e.g., n=4, i.e., 1010) of the current pixel value CP of 168 including the first selection bit cur[4] of "0" and the second "n" most significant bits PMSB (i.e. 0101) of the previous pixel value PP of 90 including the second selection bit pre[4] of "1". The plurality of addresses ADD0=42, ADD1=43, ADD2=42, and ADD3=43 may be generated as follows.

The bit depth of CMSB (i.e., 1010) and PMSB (i.e.; 0101) can be variable and LUT size, for example, such as the LUT illustrated in FIG. 6 can be variable. The first sub-address generator 311 generates the first sub-addresses A0=42, A1=43, A2=42, and A3=43 in the first matrix pattern in response to the first "n" most significant bits CMSB "1010" of the current pixel value CP "168" and the second "n" most significant bits PMSB "0101" of the previous pixel value PP "90". The first adder 311-1 adds "1" to the first "n" most significant bits CMSB "1010" of the current pixel value CP "168" to output a binary number "1011". The second adder 311-3 adds "1" to the second "n" most significant bits PMSB "0101" of the previous pixel value PP "90" to output a binary number "0110". The first shifter 311-5 shifts an upper "r" (where "r" is a natural number, e.g., 3) bits Cur[7:5] "101" in the first "n" most significant bits CMSB "1010" of the current pixel value CP "168" to the left by "5" (where "s" is a natural number, e.g., 3) to output a decimal number "40". The second shifter 311-7 selects "p" (where "p" is a natural number, e.g., 4) bits C[4:1] "0101" in the bits "1011" output from the first adder 311-1 and shifts the selected "p" bits C[4:1] "0101" to the left by "s" (i.e., 3) to output a decimal number "40". The third adder 311-9 adds the decimal "40" output from the first shifter 311-5 and an upper "r" bits Pre[7:5] "010" selected from the second "n" most significant bits PMSB "0101" of the previous pixel value PP "90" to output a decimal "42". The fourth adder 311-11 adds the decimal "40" output from the first shifter 311-5 and "p" bits P[4:1] "0011" selected from the binary number "0110" output from the second adder 311-3 to output a decimal "43". The fifth adder 311-13 adds the decimal "404" output from the second shifter 311-7 and the upper "r" bits Pre[7:5] "010" selected from the second "n" most significant bits PMSB "0101" of the previous pixel value PP "90" to output a decimal number "42". The sixth adder 311-15 adds the decimal 440 output from the second shifter 311-7 and "p" bits P[4:1] "0011," selected from the binary number "0110" output from the second adder 311-3 to output a decimal "43".

The second sub-address generator 313 generates the second sub-addresses A4=72 and A5=66 in the second matrix pattern in response to the first "n" most significant bits CMSB "1010" of the current pixel value CP "168" and the second "n" most significant bits PMSB "1010" of the previous pixel value PP "90". The seventh adder 313-1 selects the upper "r" bits Cur[7:5] "101" from the first "n" most significant bits CMSB "1010" of the current pixel value CP "168" and adds the upper "r" bits Cur[7:5] "101" and a decimal number "72" to output a decimal number "77". The second adder 313-2 selects the upper C' bits Pre[7:5] "010" from the second "n" most significant bits PMSB "0101" of the previous pixel value PP "90" and adds the upper "r" bits Pre[7:5] "010" and a decimal number 64 to output a decimal number "66".

The first selector M1 selects A1=43 as an address based on the third selection bits &cur[7:4]=1010, cur[4]=0, pre[4]=11 and &pre[7:4]=0101 and the table illustrated in FIG. 9A, and transmits the address A1=43 to the first memory 33-1. The second selector M3 selects A0=42 as an address based on the fourth selection bits cur[4]=0, pre[4]=1, and &pre[7:4]=0101 and the table illustrated in FIG. 9A, and transmits the address A0=42 to the second memory 33-3. The third selector M5 selects A3-43 as an address based on the fifth selection bits &cur[7:4]=1010, cur[4]=0, and pre[4]=1 and the table illustrated in FIG. 9A, and transmits the address A3=43 to the third memory 33-5. The fourth selector M7 selects A2=42 as an address based on the sixth selection bits cur[4]=0 and pre[4]=1 and the table illustrated in FIG. 9A, and transmits the address A2=42 to the fourth memory 33-7.

For clarity of description, real correction parameter values are not recorded in the first through fourth LUTs, but a real correction parameter value can be obtained by applying a coordinate value to the LUT illustrated in FIG. 5.

In an operation S20, the memory unit 33 outputs the correction parameters PRM0 through PRM3, which respectively correspond to the addresses ADD0 through ADD3, to the parameter arranging unit 35 in response to the addresses ADD0 through ADD3.

The first memory 33-1 outputs a decimal "213" which refers to the first LUT illustrated in FIG. 8A, in response to the address A1=43. The second memory 33-3 outputs a decimal "189", which refers to the second LUT illustrated in FIG. 5B, in response to the address A0=42. The third memory 33-5 outputs a decimal "232", which refers to the third LUT illustrated in FIG. 5C in response to the address A5=43. The fourth memory 33-7 outputs a decimal "212", which refers to the fourth LUT illustrated in FIG. 8D, in response to the address A2=42.

In an operation S30, the parameter arranging unit 35 receives the correction parameters PRM0=213, PRM1=189, PRM2=232, and PRM3=212, and arranges them into an index pattern in response to the first selection bit cur[4] "0" and the second selection bit pre[4] "1" to output the arranged correction parameters PRM0' through PRM3'. Since the combination of the first selection bit cur[4] "0" and the second selection bit pre[4] "1" is (0,1); the index pattern (b) illustrated in FIG. 7 is used. According to the index pattern (b), the second correction parameter PRM1 corresponding to the index "1" is the decimal "189", the first correction parameter PRM0 corresponding to the index "0" is the decimal "213", the fourth correction parameter PRM3 corresponding to the index "3" is the decimal "212", and the third correction parameter PRM2 corresponding to the index "2" is the decimal "232".

At least one embodiment of the present invention may be stored as computer readable codes on a computer readable recording medium. The computer readable recording medium is any data storage device that can store data which can be thereafter read by a computer system. Examples of the computer readable recording medium include read-only memory (ROM), RAM, CD-ROMs, magnetic tapes, floppy disks, and optical data storage devices.

According to at least one embodiment of the present invention, correction parameters for a current pixel can be simultaneously extracted without wasting clock cycles by using memories respectively storing LUTs which are classified by indexes. In addition, according to at least one exemplary embodiment of the present invention, since the correction parameters for the current pixel can be extracted using the memories classified by indexes, the capacity of memory can be reduced.

While the present invention has been shown and described with reference to exemplary embodiments thereof it will be understood by those of ordinary skill in the art that various changes in form and detail may be made herein without departing from the spirit and scope of the present invention, as defined by the following claims.

What is claimed is:

1. A semiconductor device comprising:

an address generator configured to output a plurality of addresses in response to a first number of most significant bits of a current pixel value including a first selection bit and a second number of most significant bits of a previous pixel value including a second selection bit;

an output unit configured to determine correction parameters, which respectively correspond to the plurality of addresses, in response to the plurality of addresses, to select an index pattern from a plurality of index patterns in response to the first selection bit and the second selection bit, and to arrange the determined correction parameters into the selected index pattern to output arranged correction parameters;

a ratio generator configured to calculate a distance ratio between the correction parameters in response to a first number of least significant bits of the current pixel value and a second number of least significant bits of the previous pixel value; and a bilinear interpolator configured to perform bilinear interpolation based on the correction parameters and the distance ratio output from the ratio generator to generate a correction value for the current pixel value, wherein the index pattern is a pattern that can be generated according to positions of the determined correction parameters in a look-up table including the plurality of indexes.

2. The semiconductor device of claim 1, wherein the output unit comprises:

a memory unit configured to output the correction parameters, which respectively corresponds to the plurality of addresses, in response to the plurality of addresses; and a parameter arranging unit configured to receive the correction parameters from the memory unit and to arrange the received correction parameters into the index pattern in response to the first selection bit and the second selection bit, and wherein the memory unit comprises a plurality of memories, each of which stores a plurality of correction parameters according to an index among the plurality of indexes.

3. The semiconductor device of claim 1, wherein the address generator comprises:

an address generation section configured to generate a plurality of first addresses based on the first number of most significant bits and the second number of most significant bits; and a plurality of selectors each of which is configured to transmit an address among the plurality of first addresses to a corresponding one among the plurality of memories comprised in the output unit in response to the first number of most significant bits and the second number of most significant bits.

4. The semiconductor device of claim 3, wherein the address generation section comprises:

a first sub-address generator configured to generate a plurality of first sub-addresses in a first matrix pattern in response to the first number of most significant bits and the second number of most significant bits; and a second sub-address generator configured to generate a plurality of second sub-addresses in a second matrix pattern in response to the first number of most significant bits and the second number of most significant bits, and wherein each of the selectors transmits an address among the first sub-addresses and the second sub-addresses to the corresponding memory in response to the first number of most significant bits and the second number of "n" most significant bits.

5. The semiconductor device of claim 4, wherein the first sub-address generator performs adding and shifting on corresponding bits between the first number of most significant bits and the second number of most significant bits to generate the first sub-addresses for selecting a parameter, which is selected by the first number of most significant bits and the second number of most significant bits, and parameters, which are in a relationship of the index pattern with respect to the selected parameter, in the look-up table including the plurality of indexes.

6. The semiconductor device of claim 4, wherein the first sub-address generator comprises:

an adding and shifting part configured to perform adding and shifting on the corresponding bits between the first number of most significant bits and the second number of most significant bits to output added and shifted addresses; and an adding part configured to add addresses selected from among the added and shifted addresses to generate the first sub-addresses.

7. The semiconductor device of claim 1, wherein each of the current pixel value and the previous pixel value indicate a pixel value for a color including red, green, or blue components.

8. A display apparatus comprising:

a display panel;

a semiconductor device comprising:

an address generator configured to generate a plurality of addresses based on only a first number of most significant bits of a current pixel value and only a second number of most significant bits of a previous pixel value, wherein the first number of most significant bits is distinct from a third number of least significant bits of the current pixel value and one bit of the first number of most significant bits is a first selection bit, wherein the second number of most significant bits is distinct from a fourth number of least significant bits of the previous pixel value and one bit of the second number of most significant bits is a second selection bit, wherein the addresses are based on first sub-addresses generated from shifting the first number of most significant bits, second sub-addresses generated from adding one to the first number of most significant bits and shifting the result, third sub-addresses generated from the second number of most significant bits, and fourth sub-addresses generated from adding one to the second number of most significant bits;

an output unit configured to determine correction parameters, which respectively correspond to the plurality of addresses, in response to the plurality of addresses, to select an index pattern from a plurality of index patterns in response to the first selection bit and the second selection bit, and to arrange the determined correction parameters into the selected index pattern to output arranged correction parameters; and a controller to control input and output of the current pixel, the previous pixel and the correction parameters between the semiconductor device and the display panel, wherein the index pattern is a pattern that can be generated according to positions of the determined correction parameters in a look-up table including the plurality of indexes.

9. A method of generating correction parameters, comprising:

generating a plurality of addresses based on only a first number of most significant bits of a current pixel value and only a second number of most significant bits of a previous pixel value, wherein one of the first most significant bits is a first selection bit and one of the second most significant bits is a second selection bit;

determining correction parameters, which respectively correspond to the plurality of addresses, in response to the plurality of addresses;

selecting an index pattern from a plurality of index patterns in response to the first selection bit and the second selection bit;

arranging the determined correction parameters into the selected index pattern to generate arranged correction parameters; and outputting the arranged correction parameters, wherein the index pattern is a pattern that can be generated according to positions of the determined correction parameters in a look-up table including the plurality of indexes, wherein the first number of most significant bits is distinct from a third number of least significant bits of the current pixel value, wherein the second number of most significant bits is distinct from a fourth number of least significant bits of the previous pixel value.

10. The method of claim 9, wherein the outputting the arranged correction parameters comprises:

outputting the correction parameters, which respectively correspond to the plurality of addresses, in response to the plurality of addresses using a memory unit including a plurality of memories, each of which stores a plurality of correction parameters according to one index among the plurality of indexes; and arranging the correction parameters output from the memory unit into the index pattern in response to the first selection bit and the second selection bit.

11. The method of claim 9, wherein the generating of the plurality of addresses comprises:

generating a plurality of first addresses based on the first number of most significant bits and the second number of most significant bits; and transmitting an address among the plurality of first addresses to a corresponding one of each of the plurality of memories in response to the first number of most significant bits and the second number of most significant bits.

12. The method of claim 11, wherein the generating of the plurality of first addresses comprises generating a plurality of first sub-addresses in a first matrix pattern in response to the first number of most significant bits and the second number of most significant bits, and generating a plurality of second sub-addresses in a second matrix pattern in response to the first number of most significant bits and the second number of most significant bits, and wherein the transmitting of the address among the plurality of first addresses comprises transmitting the address among the first sub-addresses and the second sub-addresses to each corresponding memory in response to the first number of most significant bits and the second number of most significant bits.

13. The method of claim 12, wherein the generating of the plurality of first sub-addresses comprises performing adding and shifting on corresponding bits between the first number of most significant bits and the second number most significant bits to generate the first sub-addresses for selecting a parameter, which is selected by the first number of most significant bits and the second number of most significant bits, and parameters which are in a relationship of the index pattern with respect to the selected parameter, in the look-up table including the plurality of indexes.

14. The method of claim 12, wherein the generating of the plurality of first sub-addresses comprises:

performing adding and shifting on corresponding bits between the first number of most significant bits and the second number of most significant bits to output added and shifted addresses; and adding addresses selected from among the added and shifted addresses to generate the first sub-addresses.

15. The method of claim 9, wherein each of the current pixel value and the previous pixel value indicate a pixel value for a color including red, green, or blue components.

16. A program storage device readable by machine, tangibly embodying a non-transitory computer readable medium for storing a program of instructions executable by the machine to perform method steps for generating correction parameters, the method steps comprising:

generating a plurality of addresses based on only a first number of most significant bits of a current pixel value and only a second number of most significant bits of a previous pixel, wherein one of the first most significant bits is a first selection bit and one of the second most significant bits is a second selection bit;

determining correction parameters, which respectively correspond to the plurality of addresses, in response to the plurality of addresses;

selecting one index pattern from a plurality of index patterns in response to the first selection bit and the second selection bit;

arranging the determined correction parameters into the selected index pattern to generate arranged correction parameters; and outputting the arranged correction parameters, wherein the index pattern is a pattern that can be generated according to positions of the determined correction parameters in a look-up table including the plurality of indexes, wherein the first number of most significant bits is distinct from a third number of least significant bits of the current pixel value, wherein the second number of most significant bits is distinct from a fourth number of least significant bits of the previous pixel value.

17. The method of claim 9, wherein the addresses are based on first sub-addresses generated from shifting the first number of most significant bits, second sub-addresses generated from adding one to the first number of most significant bits and shifting the result, third sub-addresses generated from the second number of most significant bits, and fourth sub-addresses generated from adding one to the second number of most significant bits.

18. The program storage device of claim 16, wherein the addresses are based on first sub-addresses generated from shifting the first number of most significant bits, second sub-addresses generated from adding one to the first number of most significant bits and shifting the result, third sub-addresses generated from the second number of most significant bits, and fourth sub-addresses generated from adding one to the second number of most significant bits.

* * * * *